US007980641B2

(12) United States Patent
Huang et al.

(10) Patent No.: US 7,980,641 B2
(45) **Date of Patent: *Jul. 19, 2011**

(54) SLIDE RAIL ASSEMBLY

(75) Inventors: Kuo-Ming Huang, Taipei Hsien (TW); Mo-Ming Yu, Shenzhen (CN); Zong-Yuan Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 852 days.

This patent is subject to a terminal disclaimer.

(21) Appl. No.: 11/952,137

(22) Filed: Dec. 7, 2007

(65) Prior Publication Data

US 2008/0315741 A1 Dec. 25, 2008

(30) Foreign Application Priority Data

Jun. 22, 2007 (CN) ..... 2007 1 0200858

(51) Int. Cl.
*A47B 88/04* (2006.01)

(52) U.S. Cl. ..... 312/334.46; 312/333

(58) Field of Classification Search ..... 312/330.1, 312/333, 334.1, 334.7, 334.8, 334.11, 334.44, 312/334.46, 334.47, 319.1; 384/20, 21
See application file for complete search history.

(56) References Cited

U.S. PATENT DOCUMENTS

| | | | | |
|---|---|---|---|---|
| 7,404,611 | B1 * | 7/2008 | Que | 312/334.46 |
| 7,552,982 | B2 * | 6/2009 | Beaudoin | 312/334.47 |
| 7,654,624 | B2 * | 2/2010 | Huang et al. | 312/333 |
| 7,712,851 | B2 * | 5/2010 | Huang et al. | 312/333 |
| 2004/0174104 | A1 * | 9/2004 | Chen et al. | 312/334.47 |
| 2004/0201340 | A1 * | 10/2004 | Chen et al. | 312/334.46 |

FOREIGN PATENT DOCUMENTS

| | | | |
|---|---|---|---|
| CN | 1723821 | A | 1/2006 |

* cited by examiner

*Primary Examiner* — James O Hansen
(74) *Attorney, Agent, or Firm* — Frank R. Niranjan

(57) ABSTRACT

A slide rail assembly includes an outer slide rail having a protrusion, an intermediate slide rail having a slot, an inner slide rail having a stop portion, a latch member slidably attached to the slot of the intermediate slide rail, and a resilient member connected to the latch member for returning the latch member to an original position. The latch member includes a first engaging portion and a second engaging portion located at opposite sides of the intermediate slide rail. The stop portion engages with the first engaging portion of the latch member such that the inner slide rail is capable of driving the intermediate slide rail to simultaneously slide out from the outer slide rail. The protrusion engages with the second engaging portion of the latch member to bias the latch member to slide along the slot to release the stop portion from the first engaging portion.

10 Claims, 6 Drawing Sheets

SLIDE RAIL ASSEMBLY

BACKGROUND

1. Field of the Invention

The present invention relates to a slide rail assembly.

2. Description of Related Art

Traditionally, a slide rail is used between two objects that can move relative to each other, such as between a desk and a drawer, a server and a rack etc.

A conventional slide rail assembly for a drawer and a desk includes an outer slide rail mounted to the desk, an inner slide rail mounted to the drawer, and an intermediate slide rail mounted between the outer and inner slide rails. The intermediate slide rail is extendable relative to the outer slide rail, and the inner slide rail is extendable relative to the intermediate slide rail, thus the drawer can be extended a distance out from the desk. Considerations of strength and smoothness of operation may render a given order or sequence preferable in a given slide configuration. Further, activation of external mechanisms such as cabinet interlocks may require a specific sequence of operation.

Consequently, it is required to provide a slide rail assembly having a latch mechanism urging collapsing of slide rails in a specific desired order.

SUMMARY

In one embodiment, a slide rail assembly includes an outer slide rail having a protrusion, an intermediate slide rail having a slot, an inner slide rail having a stop portion, a latch member slidably attached to a slot of the intermediate slide rail, and a resilient member connected to the latch member for returning the latch member to an original position. The latch member includes a first engaging portion and a second engaging portion located at opposite sides of the intermediate slide rail. The stop portion is capable of engaging with the first engaging portion of the latch member such that the inner slide rail is capable of driving the intermediate slide rail to simultaneously slide out from the outer slide rail. The protrusion is capable of engaging with the second engaging portion of the latch member to bias the latch member to slide along the slot to release the stop portion from the first engaging portion.

Other advantages and novel features of the present invention will become more apparent from the following detailed description of embodiment when taken in conjunction with the accompanying drawings, in which:

DETAILED DESCRIPTION

Figure 1:
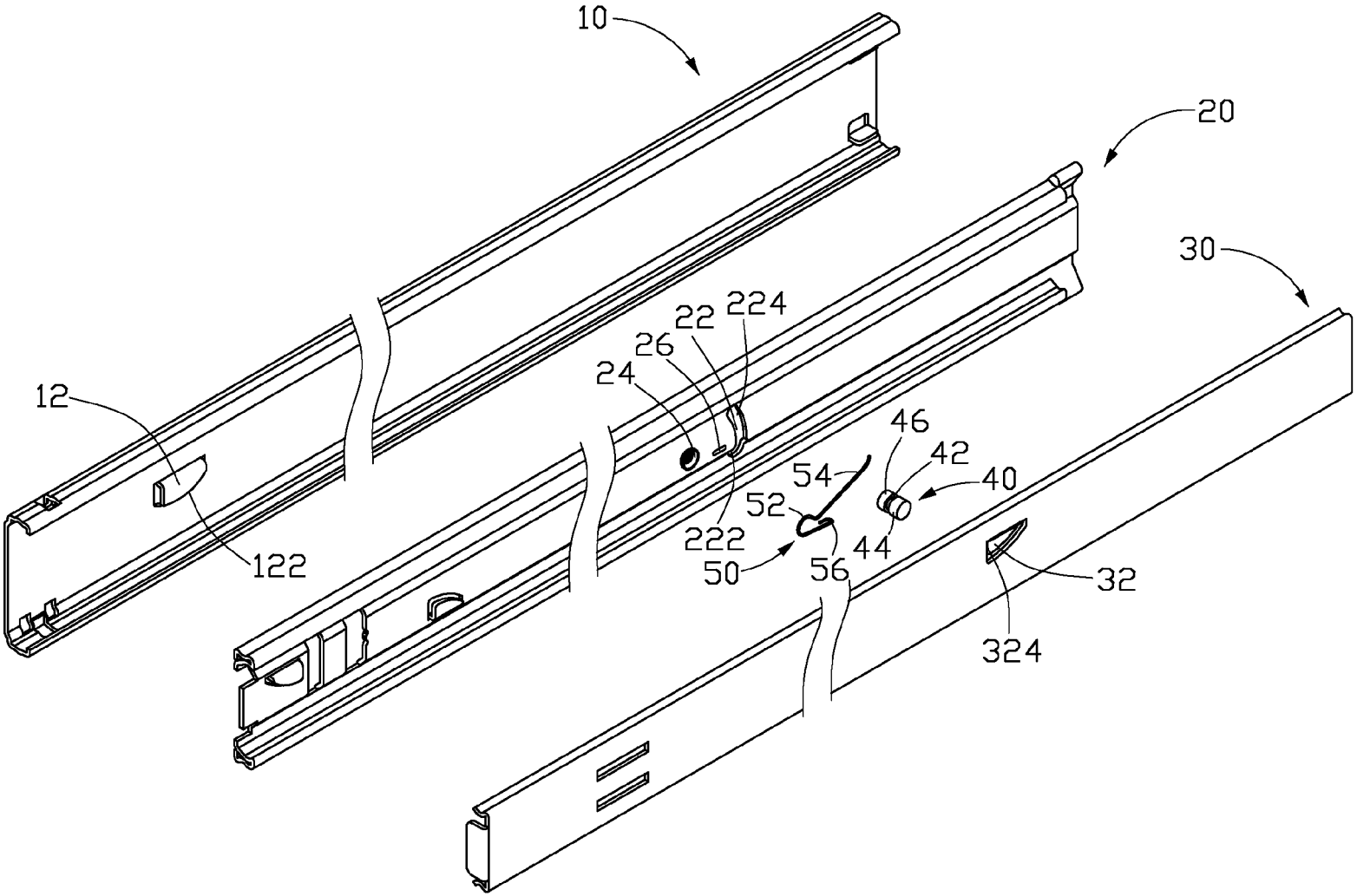
FIG. 1 is an exploded, isometric view of a slide rail assembly according to an embodiment of the present invention, the slide rail assembly including an outer slide rail, an intermediate slide rail, an inner slide rail, a latch member, and a resilient member.
Figure 2:
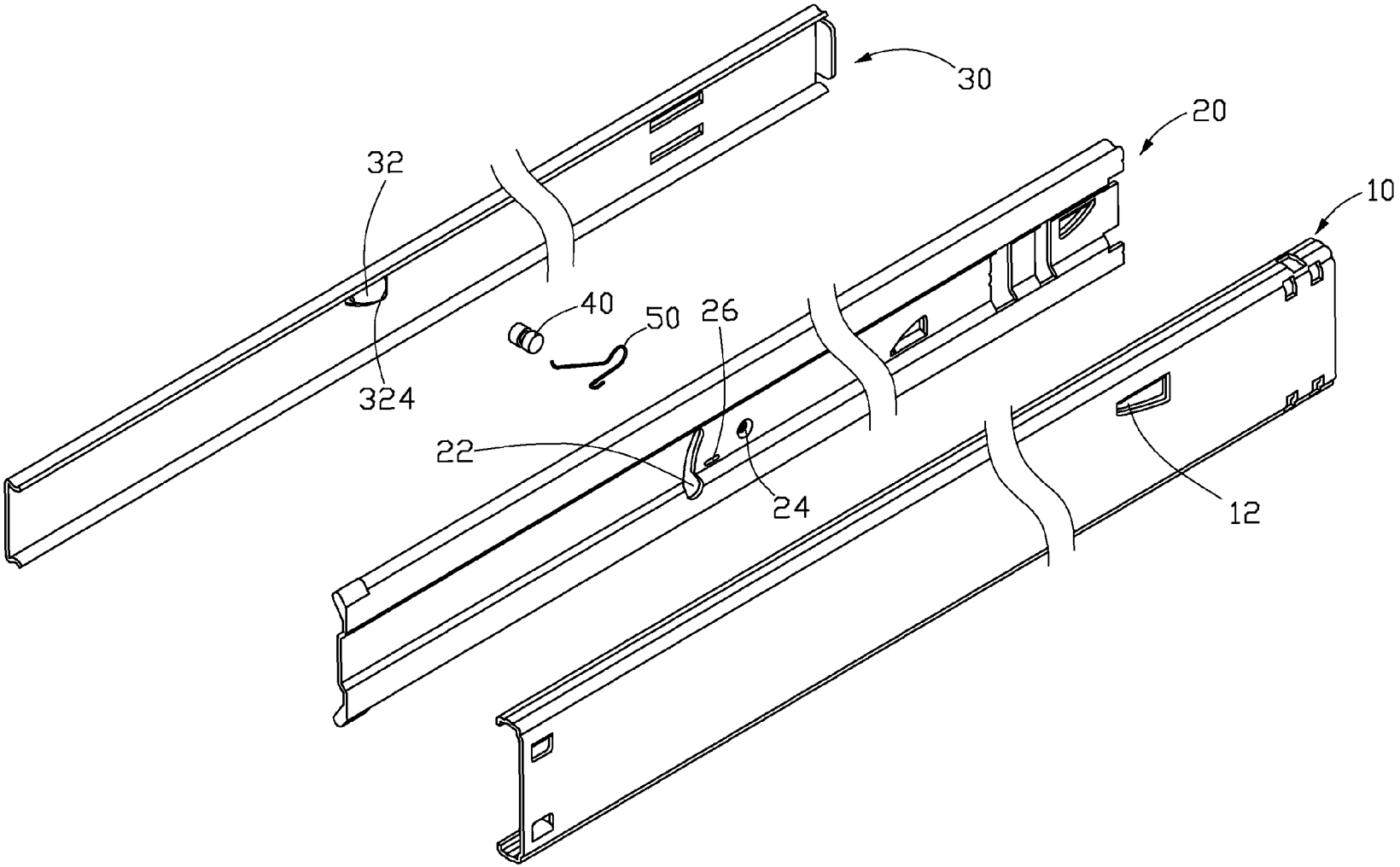
FIG. 2 is similar to FIG. 1, but viewed from another aspect.

Referring to FIGS. 1 and 2, in an embodiment of the present invention, a slide rail assembly includes an outer slide rail 10, an intermediate slide rail 20, an inner slide rail 30, a latch member 40, and a resilient member 50.

The outer slide rail 10 includes an outer portion and two sidewalls extending from opposite sides of the outer portion. A protrusion 12 parallel to the outer portion is stamped inward from the outer portion of the outer slide rail 10. The protrusion 12 includes an inclined surface 122 at a bottom thereof sloping up from a first end to a second end thereof.

The intermediate slide rail 20 includes an intermediate portion and two sidewalls extending from opposite sides of the intermediate portion respectively. The intermediate portion defines an arc-shaped slot 22. A mounting portion 24 protrudes inward from the intermediate portion adjacent to the slot 22. An aperture 26 is defined in the intermediate portion between the slot 22 and the mounting portion 24. The slot 22 has a large end at a bottom and a small end at a top thereof.

The inner slide rail 30 includes an inner portion and two sidewalls extending from opposite sides of the inner portion respectively. A stop portion 32 is stamped toward the intermediate portion of the intermediate slide rail 20 from the inner portion. The stop portion 32 has a stop surface 324 at an end thereof.

The latch member 40 includes a first engaging portion 44 at an end thereof, a second engaging portion 46 at an opposite end thereof, and a neck portion 42 between the first engaging portion 44 and the second engaging portion 46.

The resilient member 50 is generally R-shaped, and made of a resilient metal wire or similar material. The resilient member 50 includes a mounting portion 52 at a middle portion thereof, and a pressing portion 54 and a locking portion 56 at opposite ends thereof respectively.

Figure 3:
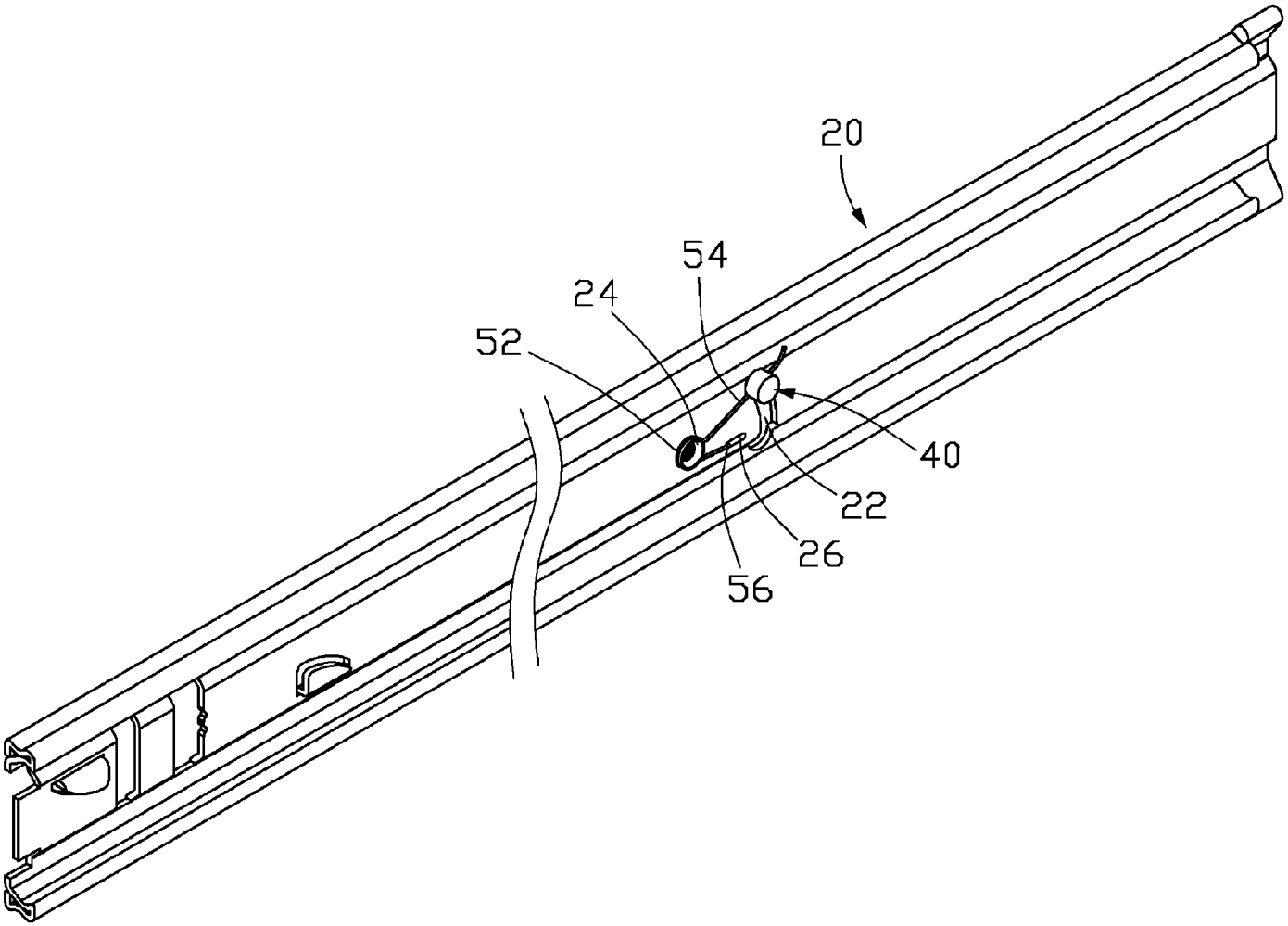
FIG. 3 is an enlarged, assembled view of the intermediate slide rail, the latch member, and the resilient member of FIG. 1.
Figure 4:
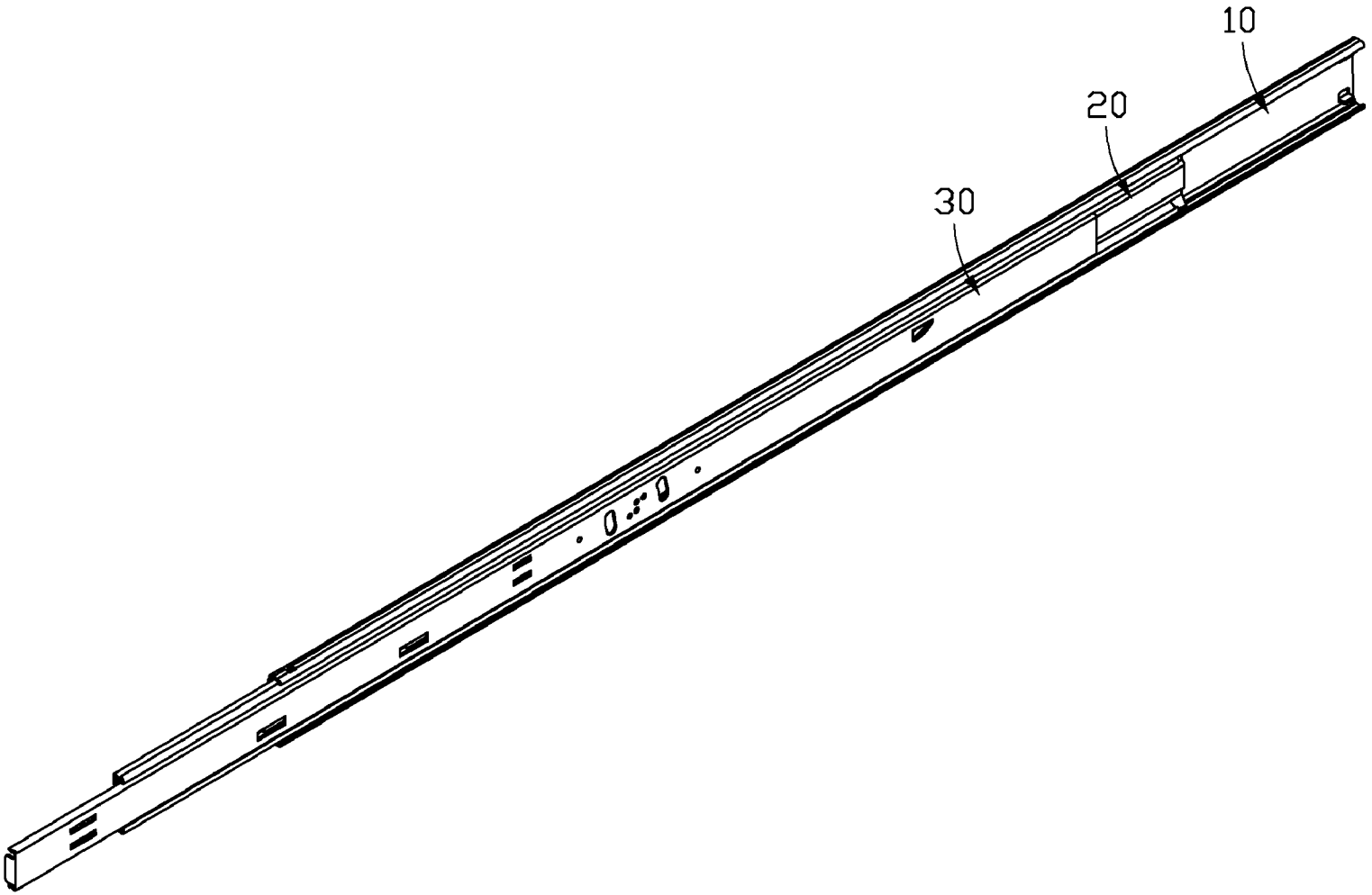
FIG. 4 is an assembled view of FIG. 1.

Referring also to FIGS. 3 and 4, in assembly, the first engaging portion 44 of the latch member 40 is inserted through the large end of the slot 22 of the intermediate slide rail 20, and moved up, with the neck portion 42 of the latch member 40 accommodated in the small end of the slot 22. The first engaging portion 44 is located at a side of the intermediate portion of the intermediate slide rail 20 facing the inner portion of the inner slide rail 30, and the second engaging portion 46 is located at an opposite side of the intermediate portion of the intermediate slide rail 20 facing the outer portion of the outer slide rail 30. The mounting portion 52 of the resilient member 50 is fixed around the mounting portion 24 of the intermediate slide rail 20. The pressing portion 54 of the resilient member 50 is resiliently loaded on the neck portion 42 of the latch member 40 between the intermediate portion of the intermediate slide rail 20 and the first engaging portion 44 of the latch member 40. The locking portion 56 of the resilient member 50 is locked in the aperture 26 of the intermediate slide rail 20. The outer, intermediate, and inner slide rails 10, 20, 30 are nested in sequence to form the slide rail assembly.

Figure 5:
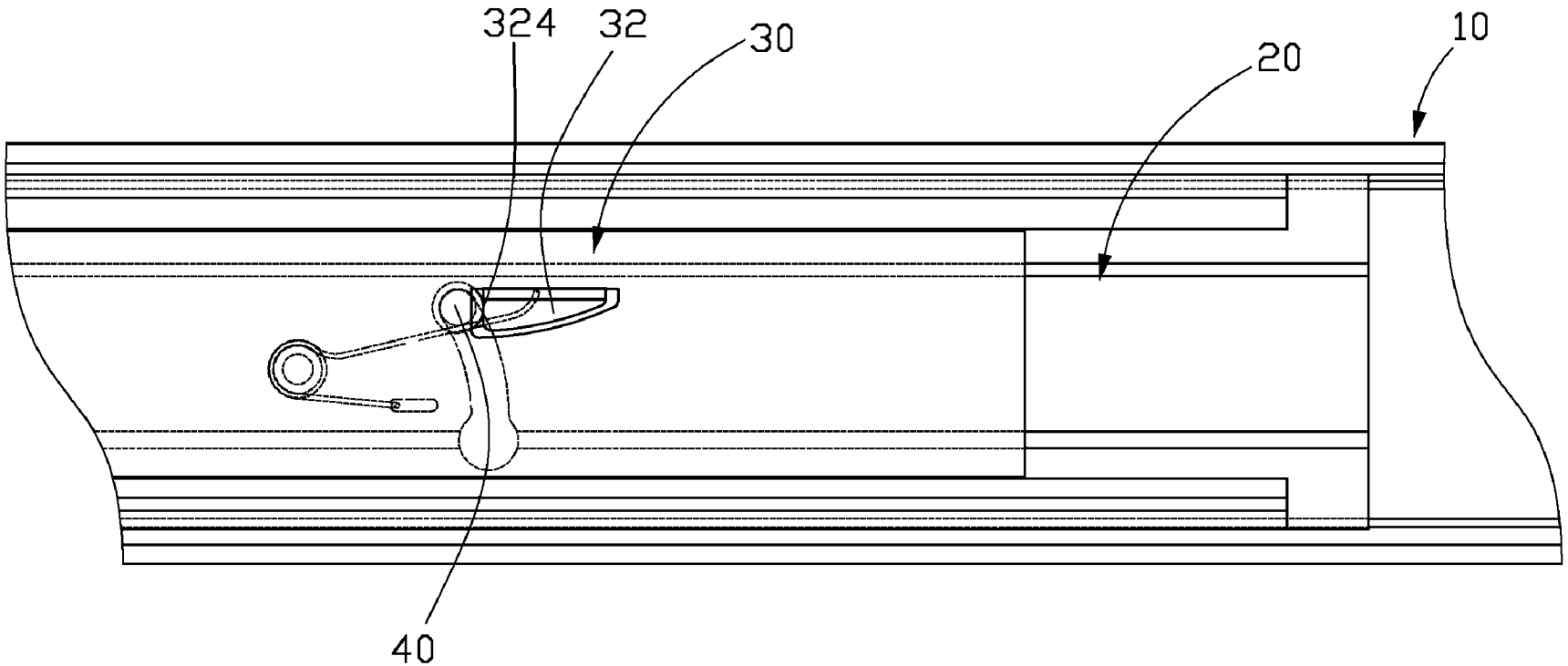
FIGS. 5-6 are assembled, lateral views of FIG. 1, showing the slide rail assembly in two states.

Referring also to FIG. 5, in extending the slide rail assembly from a superposed state, the inner slide rail 30 is pulled to slide out from the intermediate slide rail 20. When the stop portion 32 of the inner slide rail 30 moves to the latch member 40, the stop surface 324 of the stop portion 32 engages with the first engaging portion 44 of the latch member 40 to drive the intermediate slide rail 20 to slide out from the outer slide rail 10.

Figure 6:
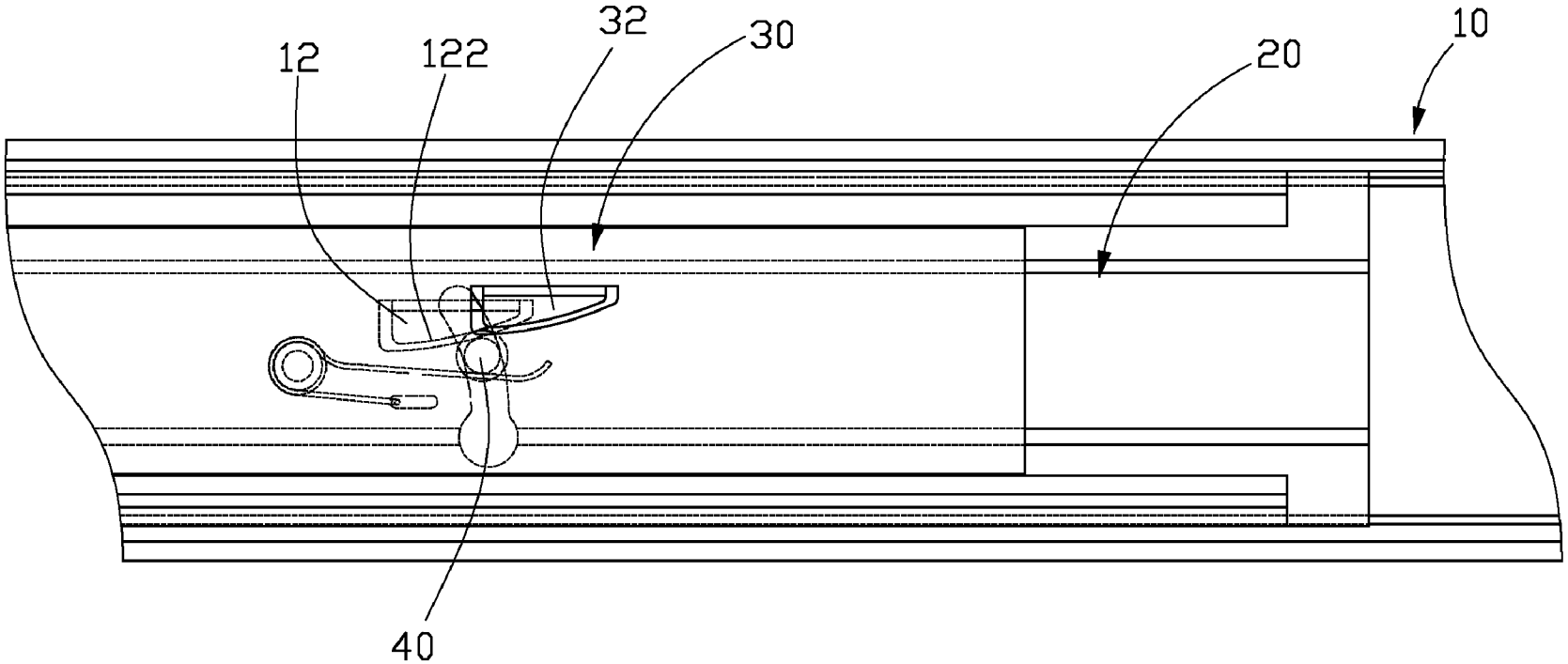

Referring also to FIG. 6, when the latch member 40 moves to the protrusion 12 of the outer slide rail 10, the inclined surface 122 of the protrusion 12 presses the second engaging portion 46 of the latch member 40 to drive the latch member 40 to slide down toward the large end of the slot 22 of the intermediate slide rail 20 against resistance of the resilient member 50, until the first engaging portion 44 of the latch member 40 is disengaged from the stop surface 324 of the stop portion 32 of the inner slide rail 30. The inner slide rail 30 continues to slide out from the intermediate slide rail 20. The resilient member 50 is restored to drive the latch member 40 to move back to the small end of the slot 22 of the intermediate slide rail 20. Thus, the slide rail assembly is at a fully extended state.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A latch mechanism for a slide rail assembly which comprises an outer slide rail, an intermediate slide rail slidably attached to the outer slide rail, and an inner slide rail slidably attached to the intermediate slide rail, comprising:

a latch member slidably attached to a slot of the intermediate slide rail, the latch member comprising a first engaging portion and a second engaging portion located at opposite sides of the intermediate slide rail respectively;

a stop portion arranged on the inner slide rail capable of engaging with the first engaging portion of the latch member such that the inner slide rail is capable of driving the intermediate slide rail to slide out from the outer slide rail;

a protrusion arranged on the outer slide rail, the protrusion capable of engaging with the second engaging portion of the latch member to bias the latch member to slide along the slot to release the stop portion from the first engaging portion; and a resilient member placed between the latch member and the intermediate slide rail for returning the latch member to an original position.

2. The latch mechanism as described in claim 1, wherein the second engaging portion of the latch member is located at a side of the intermediate slide rail facing the outer slide rail and the first engaging portion of the latch member is located at an opposite side of the intermediate slide rail facing the inner slide rail.

3. The latch mechanism as described in claim 2, wherein the slot has a large end at a lower portion and a small end at an upper portion thereof, the latch member further comprises a neck portion between the first and second engaging portions, the neck portion is accommodated in the small end of the slot when the latch member is in the original position.

4. The latch mechanism as described in claim 3, wherein one end of the resilient member engages with the neck portion of the latch member for biasing the latch member to the small end of the slot.

5. The latch mechanism as described in claim 1, wherein the resilient member is made of a resilient metal wire and comprises a ring-shaped mounting portion at a middle thereof configured for being fixed around a mounting portion of the intermediate slide rail, and a pressing portion formed at an end thereof to be resiliently loaded on the latch member.

6. The latch mechanism as described in claim 1, wherein the protrusion comprises an inclined surface sloping up from a first end thereof to a second end.

7. A slide rail assembly comprising:

an outer slide rail having a protrusion arranged thereon;

an intermediate slide rail slidably attached to the outer slide rail, the intermediate slide rail defining a slot therein;

an inner slide rail slidably attached to the intermediate slide rail, the inner slide rail having a stop portion;

a latch member attached to the intermediate slide rail and slidably along the slot of the intermediate slide rail, the latch member comprising a first engaging portion capable of engaging with the stop portion of the inner slide rail to drive the intermediate slide rail to extend out from the outer slide rail together with the inner slide rail, and a second engaging portion capable of engaging with the protrusion of the outer slide rail to make the outer slide rail drive the latch member to move along the slot of the intermediate slide rail to disengage the first engaging portion from the stop portion of the inner slide rail, thereby releasing the inner slide rail from the intermediate slide rail to allow the inner slide rail to slide out from the intermediate slide rail; and a resilient member connected to the latch member and the intermediate slide rail for restoring the latch member.

8. The slide rail assembly as described in claim 7, wherein the latch member further comprises a neck portion formed between the first and second engaging portions and slidably engaged with two sidewalls bounding the slot of the intermediate slide rail.

9. The slide rail assembly as described in claim 8, wherein the resilient member is made of a resilient metal wire, and comprises a ring-shaped mounting portion at a middle thereof being fixed to the intermediate slide rail, and a pressing portion formed at an end thereof to be resiliently loaded on the neck portion of the latch member, the intermediate slide rail further defines an aperture therein, an opposite end of the resilient member is engaged in the aperture.

10. The slide rail assembly as described in claim 7, wherein the protrusion of the outer slide rail comprises an inclined surface for engaging with the second engaging portion of the latch member, to drive the latch member to move to release the intermediate slide rail from the inner slide rail when extending the outer, intermediate, and inner slide rails.

* * * * *